United States Patent [19]

Roth

[11] 4,240,310

[45] Dec. 23, 1980

[54] SOCKET WRENCH

[76] Inventor: Edmund H. Roth, 6310 SW. 4th Pl., Margate, Fla. 33063

[21] Appl. No.: 24,526

[22] Filed: Mar. 28, 1979

[51] Int. Cl.[3] ..... B25B 17/00

[52] U.S. Cl. ..... 81/57.29; 81/57.3

[58] Field of Search ..... 81/57.29, 57.3

[56] References Cited

U.S. PATENT DOCUMENTS

| | | | |
|---|---|---|---|
| 1,487,785 | 3/1924 | Knowles | 81/57.3 |
| 2,206,802 | 7/1940 | Brenming | 81/57.29 |
| 2,466,456 | 4/1949 | Lybyer | 81/57.29 |
| 2,532,027 | 11/1950 | Maddox | 81/57.3 |
| 2,764,048 | 9/1956 | Thompson | 81/57.29 |
| 3,532,012 | 10/1970 | Pryor | 81/57.29 |
| 3,564,955 | 2/1971 | Batchelder | 81/57.29 |

*Primary Examiner*—James L. Jones, Jr.
*Attorney, Agent, or Firm*—Oltman and Flynn

[57] ABSTRACT

The present socket wrench has a holder in which a socket member is rotatably driven from a rotary input drive member located completely to one side of the socket member. Both the holder and the rotatable socket member are thin along the socket member's axis of rotation, enabling the wrench to be applied to a nut or the head of a bolt in a closely confined space. The input drive member has a recess for receiving a power-driven rotary shaft operated by a power tool, such as an electric drill.

2 Claims, 8 Drawing Figures

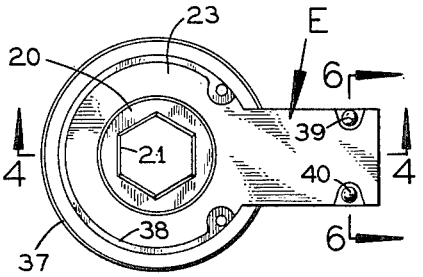
FIG. 1
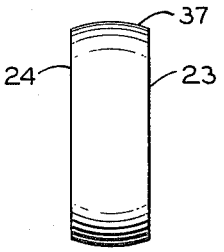
FIG. 2
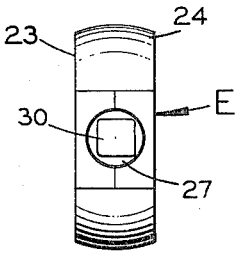
FIG. 3
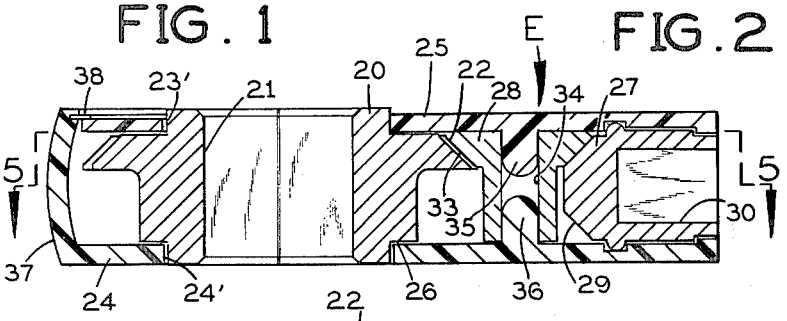
FIG. 4
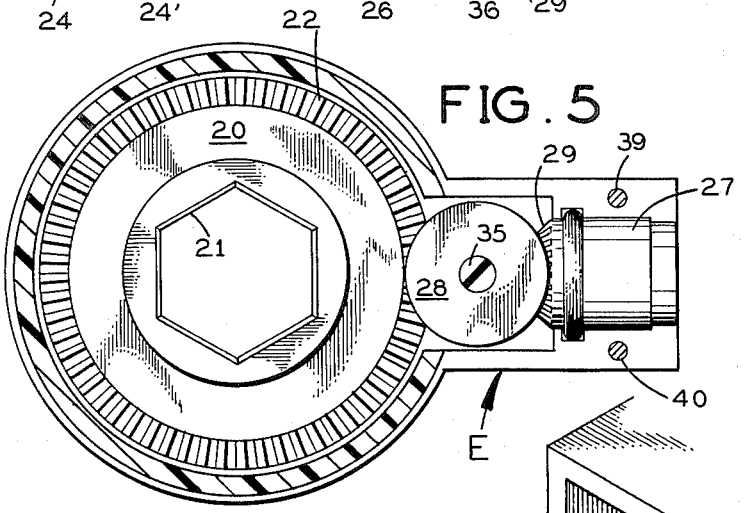
FIG. 5
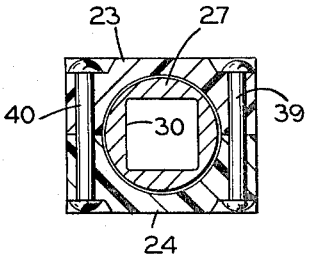
FIG. 6
FIG. 8
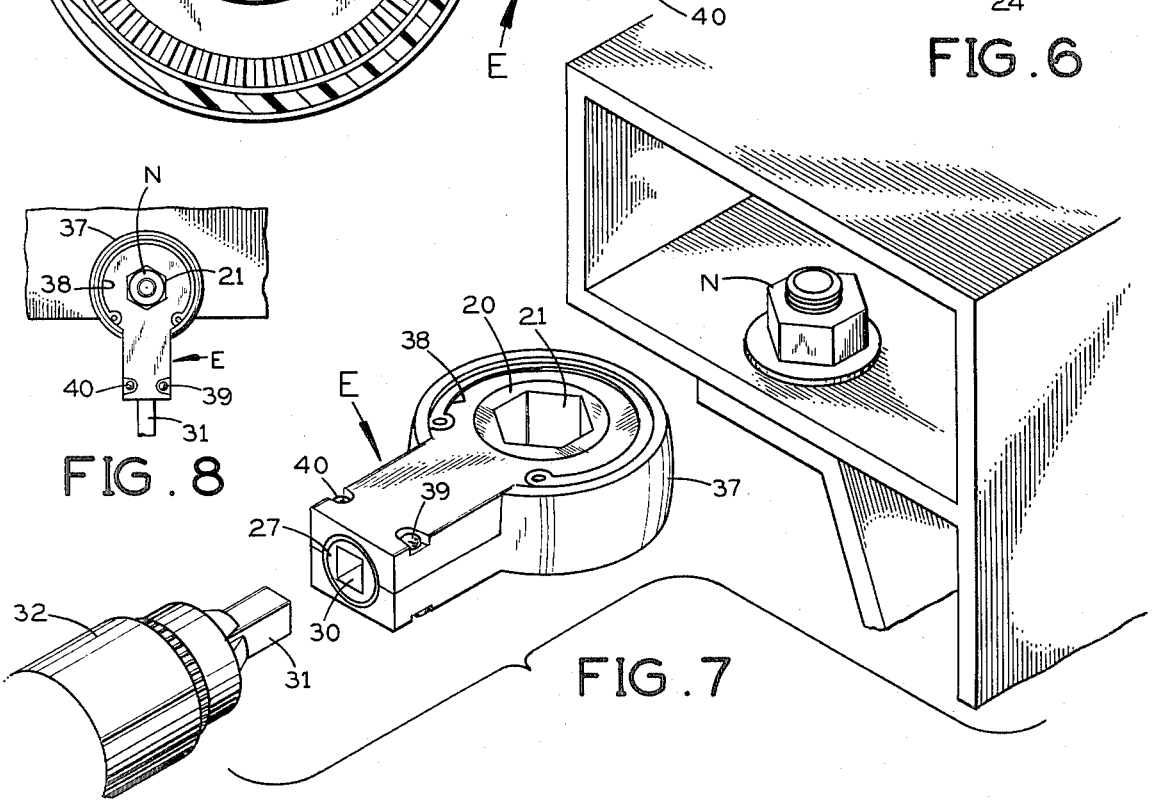
FIG. 7

SOCKET WRENCH

SUMMARY OF THE INVENTION

The present invention is directed to a novel power-driven socket wrench which is adapted to be used on nuts or bolts in closely confined spaces.

In accordance with this invention, the socket wrench comprises a socket member for insertion over the nut or the bolt head, a holder which rotatably supports the socket member, both the socket member and the holder being thin along the rotational axis of the socket member so as to fit in closely confined spaces, and a rotary input drive member located in the holder at one side of the socket member and drivingly coupled to the socket member for driving it from a rotary power tool, such as an electric drill. With this arrangement, the holder itself can remain stationary after the socket member has been engaged with the nut or the bolt head, and the moving parts (i.e., the socket member and the input drive to it) are inside the stationary holder.

A principal object of this invention is to provide a novel and improved socket wrench for use in closely confined spaces, which is adapted to be driven from a rotary power tool, such as an electric drill.

Further objects and advantages of this invention will be apparent from the following detailed description of a presently-preferred embodiment thereof, which is shown in the accompanying drawings in which:

DESCRIPTION OF THE DRAWINGS

FIG. 1 is a plan view of this invention;

FIG. 2 is an end elevational view taken from the left end of FIG. 1;

FIG. 3 is an end elevational view taken from the right end of FIG. 1;

FIG. 4 is a longitudinal section taken along the line 4—4 in FIG. 1;

FIG. 5 is a section taken along the line 5—5 in FIG. 4;

FIG. 6 is a cross-section taken along the line 6—6 in FIG. 1;

FIG. 7 is an exploded perspective view illustrating how this socket wrench can be inserted in a closely confined space and driven by a power tool; and FIG. 8 is a plan view showing the socket wrench in place on a nut.

DETAILED DESCRIPTION

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Referring first to FIGS. 4 and 5, the illustrated embodiment of the present invention has a socket member 20 with a hexagonal opening 21 at the center for snugly receiving a nut or the head of a bolt. The socket member is formed with a series of bevel gear teeth 22 which extend circularly about the axis of the socket member, which is located at the center of its opening 21.

The socket member 20 is rotatably supported inside a generally circular part of a two-piece holder having upper and lower pieces 23 and 24 (FIG. 4) which fit together to enclose the socket member. As shown in FIG. 1, the holder is generally keyhole-shaped in outline, and it presents a generally rectangular reduced extension E at one side of the circular part where the socket member 20 is located. Preferably, this holder is made of suitable self-lubricating plastic material, which makes it unnecessary to provide anti-friction bearings for the socket member.

As shown in FIG. 4, the holder presents aligned, circular openings 23′ and 24′ in the top and bottom which snugly but rotatably receive the reduced circular upper and lower ends of the socket member 20. Between its reduced upper end and the bevel gear teeth 22, the socket member 20 presents a flat annular shoulder 25 which extends closely beneath the top piece 23 of the holder laterally outward from the opening 23′. Just above its reduced lower end the socket member 20 presents a flat annular shoulder 26 which closely overlies the bottom piece 24 of the holder laterally outward from the opening 24′. It is to be understood that the socket member 20 has a close running fit inside the holder at these shoulders 25, 26 and at the openings 23′ and 24′ in the holder. The clearance between the socket member and the holder at these locations is somewhat exaggerated in FIG. 4 for clarity.

At its circular part where the socket member 20 is located, the bottom piece 24 of the holder is generally cup-shaped, presenting an upstanding peripheral wall 37 which extends circularly around the gear teeth 22 on the socket member 20 except at the extension E. At its circular part, the top piece 23 of the holder is thin and flat and has a close fit inside the top of the peripheral wall 37 of the bottom piece 24 of the holder. A split snap ring 38 (FIG. 4 holds the top peice in this position overlying the top shoulder 25 on the socket member 20. This snap ring is received in a groove on the inside of the peripheral wall 37 of the bottom piece of the holder.

With this arrangement, the socket member 20 is rotatably supported inside the circular part of the two-piece holder 23, 24. At this location the socket member and the holder each have an axial length which is substantially less than its width transverse to the socket opening 21. As shown in FIG. 7, this short axial dimension enables the present wrench to be inserted into a closely confined space where a nut or bolt head may be located, such as at various places on an automotive vehicle, such as a passenger car or truck. Also, the width of this circular part of the holder is made just large enough to accomodate the bevel gear toothed segment 22 of the socket member 20, so as to take up as little space as possible in that direction.

The reduced lateral extension E on the holder encloses a rotary input drive arrangement for rotating the socket member 20 from a power-driven input shaft. The holder extension E is slightly thinner parallel to the rotational axis of the socket member 20 than the wider circular part which holds the socket member. In the embodiment of FIGS. 1-8, this input drive arrangement comprises an input gear member 27 and an intermediate gear member 28.

The input gear member 27 has a series of bevel gear teeth 29 at its inner end extending circularly about its rotational axis, which extends perpendicular to the rotational axis of the socket member 20. At its outer end, the input gear member has a central recess 30 of square or other polygonal cross-section for snugly receiving a complementary shaft 31 driven by an electric drill 32 or other rotary power tool. The input gear member 27 is rotatably supported between opposite halves of the holder at the latter's reduced extension E.

The intermediate gear member 28 at its upper end in FIG. 4 presents a circular series of bevel gear teeth 33 which mesh at one side with the gear teeth 29 of the input gear member 27 and mesh at the opposite side with the gear teeth 22 of the socket member 20. The intermediate gear member 28 is supported by the opposite halves of the holder extension E for rotation on an axis parallel to the rotational axis of the socket member 20. For this purpose, as shown in FIG. 4, the intermediate gear member 28 may be formed with a central opening 34 of circular cross-section which snugly but rotatably engages rounded projections 35 and 36 on the inside of the respective halves of the holder at its reduced extension E.

Rivets 39 and 40 hold the upper and lower pieces 23 and 24 of the holder assembled to each other at the extension E and rotatably supporting the intermediate gear member 28 and the input gear member 27.

As indicated in FIG. 7, the circular end of the holder 23, 24 where the socket member 20 is located may be inserted over a nut N, for example, until the opening 21 in the socket member 20 registers with the nut, and then the holder with the socket member inside is dropped down over the nut. The power-driven shaft 31 may be inserted in the end recess 30 of the input gear member 27, and when the power tool is turned on a power drive is imparted to the socket member 20 through the input gear member 27, the intermediate gear member 28 and the gear teeth 22 on the socket member 20. This enables the socket member 20 to be rotated for loosening and rmoving the nut N without moving the holder 23, 24. Once the holder 23, 24 is slipped over the nut, no further manipulation of the holder is required.

In the illustrated embodiment, both the holder and the rotatable socket member are thin along the rotational axis of the socket member, each being substantially shorter in that direction than its width transverse to the central opening in the socket member. This enables this part of the socket wrench to be inserted into a closely confined space for engagement with a nut or the head of a bolt located there. Once applied to the nut or bolt, the holder of the socket wrench remains stationary, requiring no turning or other manipulation by the user, while the power drive is imparted through moving parts inside the holder. Therefore, the power-driven operation of the socket wrench requires no additional clearance beyond the relatively small clearance required for applying it initially to the nut or bolt.

I claim:

1. In a power-driven socket wrench having:

a socket member with a polygonal central opening for engaging a nut or a bolt head;

and a holder extending circumferentially around and rotatably supporting said socket member for rotation on an axis at the center of said opening;

said socket member having a series of gear teeth thereon extending circularly around its axis;

said socket member having an axial length which is substantially less than its width transverse to said opening;

said holder where it surrounds the socket member also having a dimension axially of said socket member which is substantially less than its width thereat tranversely of the socket member, whereby the holder with the rotatable socket member therein is insertable into a closely confined space;

the improvement which comprises:

a rotary input gear located in said holder completely to one side of the socket member and rotatable on an axis extending perpendicular to the rotational axis of the socket member, said input gear having an axial recess in its outer end for receiving a power-driven rotary shaft and having a series of gear teeth on its inner end extending circularly about its axis;

and an intermediate gear located in said holder at said one side of the socket member between said input gear and said socket member, said intermediate gear being rotatable on an axis extending parallel to the rotational axis of said socket member and having a circular series of gear teeth which mesh with said gear teeth on the input gear and with said gear teeth on the socket member for imparting the power drive from the input gear to the socket member.

2. A socket wrench according to claim 1, wherein said holder throughout its extent at said one side of the socket member where said intermediate gear and said input gear are located has a dimension axially of the socket member not substantially greater than said dimension of the holder where it surrounds the socket member.

* * * * *